US011646144B2

(12) United States Patent
Hirukawa

(10) Patent No.: US 11,646,144 B2
(45) Date of Patent: May 9, 2023

(54) MULTILAYER COIL COMPONENT

(71) Applicant: Murata Manufacturing Co., Ltd., Kyoto-fu (JP)

(72) Inventor: Atsuo Hirukawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 306 days.

(21) Appl. No.: 16/881,526

(22) Filed: May 22, 2020

(65) Prior Publication Data

US 2020/0373054 A1 Nov. 26, 2020

(30) Foreign Application Priority Data

May 24, 2019 (JP) ..... JP2019-097639

(51) Int. Cl.
*H01F 27/28* (2006.01)
*H01F 17/00* (2006.01)

(52) U.S. Cl.
CPC ..... *H01F 17/0013* (2013.01); *H01F 27/2885* (2013.01)

(58) Field of Classification Search
CPC ..... H01F 27/323; H01F 2027/2809; H01F 17/0013; H01F 27/292; H01F 27/2804
See application file for complete search history.

(56) References Cited

U.S. PATENT DOCUMENTS 6,157,285 A * 12/2000 Tokuda ..... H01F 17/0013 336/200
9,966,183 B2 * 5/2018 Yamauchi ..... H01F 27/2804
2002/0057174 A1 * 5/2002 Uchikoba ..... H01F 41/041 336/200
2005/0122699 A1 6/2005 Maeda et al.
(Continued)

FOREIGN PATENT DOCUMENTS

CN 212434376 U 1/2021
JP 2000-138120 A 5/2000
(Continued)

OTHER PUBLICATIONS

An Office Action; "Notice of Reasons for Refusal," mailed by the Japanese Patent Office dated Dec. 21, 2021, which corresponds to Japanese Patent Application No. 2019-097639 and is related to U.S. Appl. No. 16/881,526 with English translation.

*Primary Examiner* — Alex Torres-Rivera
(74) *Attorney, Agent, or Firm* — Studebaker & Brackett PC

(57) ABSTRACT

A multilayer coil component includes a multilayer body, and first and second outer electrodes. The multilayer body is formed by stacking plural insulating layers in a length direction, and includes a coil incorporated therein. The first and second outer electrodes are electrically connected to the coil. The coil is formed by electrically connecting plural coil conductors. The multilayer body has first and second end surfaces, first and second major surfaces, and first and
(Continued)

second lateral surfaces. Each coil conductor has a line portion, and a land portion. As viewed in plan in the stacking direction, the land portion is not located inside the inner periphery of the line portion, and partially overlaps the line portion. As viewed in plan in the stacking direction, the land portion has a diameter of from about 1.05 times to about 1.3 times the line width of the line portion.

20 Claims, 9 Drawing Sheets

(56) References Cited

U.S. PATENT DOCUMENTS

2005/0124197 A1* 6/2005 Okimoto ..... H01L 24/13 257/E23.07
2010/0253464 A1* 10/2010 Miyoshi ..... H01F 17/0013 336/200
2011/0267166 A1* 11/2011 Matsushita ..... H03H 7/0115 336/200
2016/0314891 A1* 10/2016 Onozaki ..... H01F 41/041
2018/0005752 A1* 1/2018 Takayama ..... H01F 17/0013
2018/0166206 A1 6/2018 Ueyama et al.
2018/0374628 A1* 12/2018 Yamauchi ..... H01F 27/24
2019/0198232 A1* 6/2019 Sato ..... H01F 17/04
2019/0333686 A1* 10/2019 Kazuta ..... H01F 17/0013

FOREIGN PATENT DOCUMENTS

JP 2002-134321 A 5/2002
JP 2004-153067 A 5/2004
JP 2005-167130 A 6/2005
JP 2010-245134 A 10/2010
JP 2016-189451 A 11/2016
JP 2018-098368 A 6/2018

* cited by examiner

MULTILAYER COIL COMPONENT

CROSS-REFERENCE TO RELATED APPLICATION

This application claims benefit of priority to Japanese Patent Application No. 2019-097639, filed May 24, 2019, the entire content of which is incorporated herein by reference.

BACKGROUND

Technical Field

The present disclosure relates to a multilayer coil component.

Background Art

For example, Japanese Unexamined Patent Application Publication No. 2016-189451 discloses a multilayer coil component described below. The multilayer coil component includes a base body formed by stacking plural ceramic layers, and a coil conductor disposed inside the base body. The coil conductor has a coil pattern portion, and a pattern connection portion. The coil pattern portion is disposed on each of the ceramic layers, and includes a line portion and a land portion disposed in an end portion of the line portion. The pattern connection portion connects the respective land portions of coil pattern portions that are adjacent to each other in the direction in which the ceramic layers are stacked. As viewed in the stacking direction, the land portion overlaps the line portion located opposite to the pattern connection portion in the stacking direction, and the center of the land portion does not overlap the line portion located opposite to the pattern connection portion in the stacking direction.

With the multilayer coil component described in Japanese Unexamined Patent Application Publication No. 2016-189451, the land portion has a very large diameter relative to the width of the line portion to ensure that, as viewed in the stacking direction, the center of the land portion does not overlap the line portion located opposite to the pattern connection portion. If such a coil conductor is used for a multilayer coil component having a coil axis parallel to the mounting surface, the stray capacitance due to the land portion having a large diameter may lead to degradation of the radio frequency characteristics in the radio frequency range. Further, the multilayer coil component described in Japanese Unexamined Patent Application Publication No. 2016-189451 has an exemplary configuration in which the land portion is positioned inside the inner periphery of the line portion. Such a configuration, however, results in decreased diameter (inside diameter) of the coil diameter, which may make it impossible to obtain a large impedance in the radio frequency range.

SUMMARY

The present disclosure has been made to address the above-mentioned problems, and accordingly, it is an object of the present disclosure to provide a multilayer coil component that exhibits a large impedance in the radio frequency range, and has improved radio frequency characteristics.

A multilayer coil component according to preferred embodiments of the present disclosure includes a multilayer body, and a first outer electrode and a second outer electrode.

The multilayer body is formed by stacking plural insulating layers in a length direction, and includes a coil incorporated in the multilayer body. The first outer electrode and the second outer electrode are electrically connected to the coil. The coil is formed by electrically connecting plural coil conductors that are stacked in the length direction together with the insulating layers. The multilayer body has a first end surface and a second end surface that face each other in the length direction, a first major surface and a second major surface that face each other in a height direction orthogonal to the length direction, and a first lateral surface and a second lateral surface that face each other in a width direction orthogonal to the length direction and to the height direction. The first major surface is a mounting surface. The stacking direction of the multilayer body, and the direction of the coil axis of the coil are parallel to the first major surface. The first outer electrode extends to cover at least a portion of the first end surface and to cover a portion of the first major surface. The second outer electrode extends to cover at least a portion of the second end surface and to cover a portion of the first major surface. Each coil conductor has a line portion, and a land portion disposed in an end portion of the line portion. The land portions of the coil conductors that are adjacent to each other in the stacking direction are connected with each other by a via conductor. As viewed in plan in the stacking direction, the land portion is not located inside the inner periphery of the line portion, and partially overlaps the line portion. As viewed in plan in the stacking direction, the land portion has a diameter of not less than about 1.05 times and not more than about 1.3 times (i.e., from about 1.05 times to about 1.3 times) the line width of the line portion.

Other features, elements, characteristics and advantages of the present disclosure will become more apparent from the following detailed description of preferred embodiments of the present disclosure with reference to the attached drawings.

DETAILED DESCRIPTION

A multilayer coil component according to the present disclosure will be described below. The present disclosure is not limited to the configurations described below but may be modified as appropriate without departing from the scope of the present disclosure. The present disclosure also encompasses combinations of individual preferred features described hereinbelow.

Multilayer Coil Component

Figure 1:
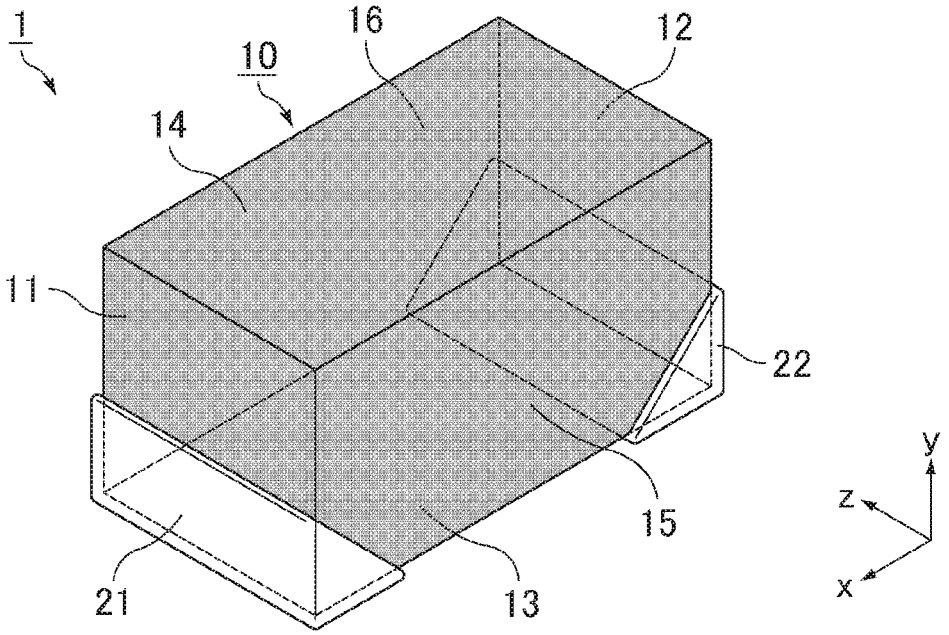
FIG. 1 is a schematic perspective view of an exemplary multilayer coil component according to the present disclosure.

FIG. 1 is a schematic perspective view of an exemplary multilayer coil component according to the present disclosure. As illustrated in FIG. 1, a multilayer coil component 1 includes a multilayer body 10, a first outer electrode 21, and a second outer electrode 22. Although the configuration of the multilayer body 10 will be described later in more detail, the multilayer body 10 is formed by stacking plural insulating layers, and includes a coil incorporated therein. The first outer electrode 21 and the second outer electrode 22 are each electrically connected to the coil.

For the multilayer coil component 1 and the multilayer body 10, the length direction, the height direction, and the width direction are respectively defined as x-direction, y-direction, and z-direction in FIG. 1. The length direction (x-direction), the height direction (y-direction), and the width direction (z-direction) are orthogonal to each other.

The multilayer body 10 has a substantially cuboid shape with six faces. The multilayer body 10 has a first end surface 11 and a second end surface 12 that face each other in the length direction, a first major surface 13 and a second major surface 14 that face each other in the height direction orthogonal to the length direction, and a first lateral surface 15 and a second lateral surface 16 that face each other in the width direction orthogonal to the length and height directions. The first major surface 13 serves as the mounting surface in mounting the multilayer coil component 1 onto a substrate.

The corners and edges of the multilayer body 10 are preferably rounded. A corner of the multilayer body 10 refers to where three faces of the multilayer body 10 meet. An edge of the multilayer body 10 refers to where two faces of the multilayer body 10 meet.

Figure 2:
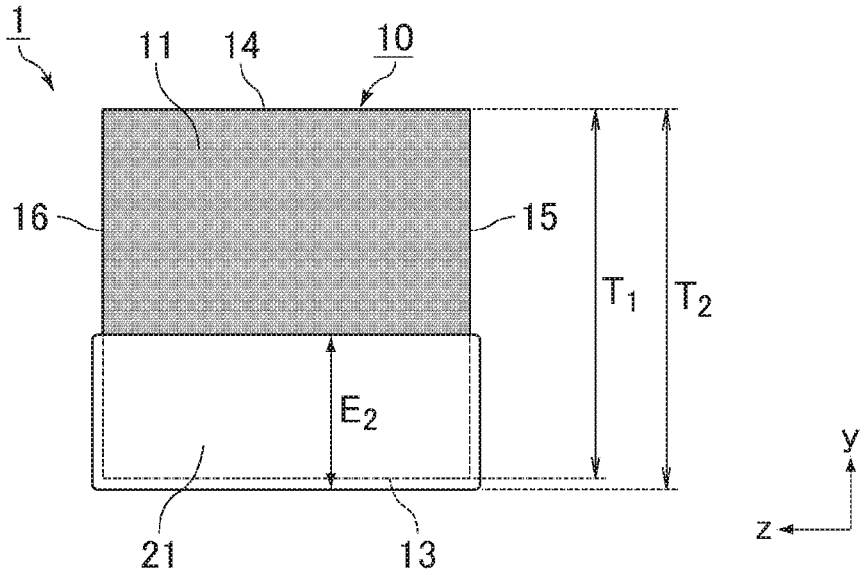
FIG. 2 is a schematic plan view of the multilayer coil component illustrated in FIG. 1 as seen from a first end surface.
Figure 3:
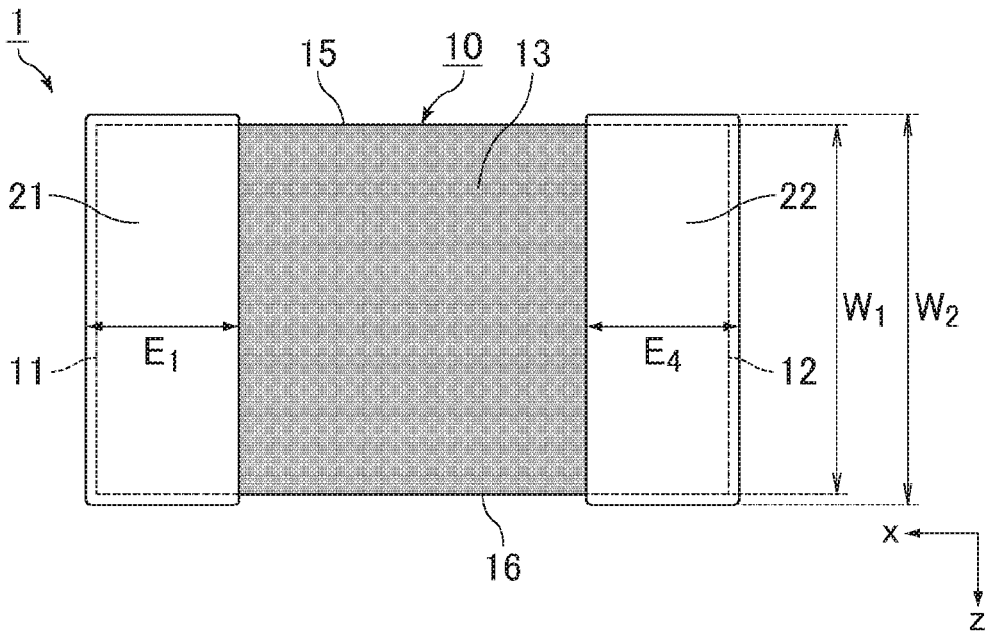
FIG. 3 is a schematic plan view of the multilayer coil component illustrated in FIG. 1 as seen from a first major surface.
Figure 4:
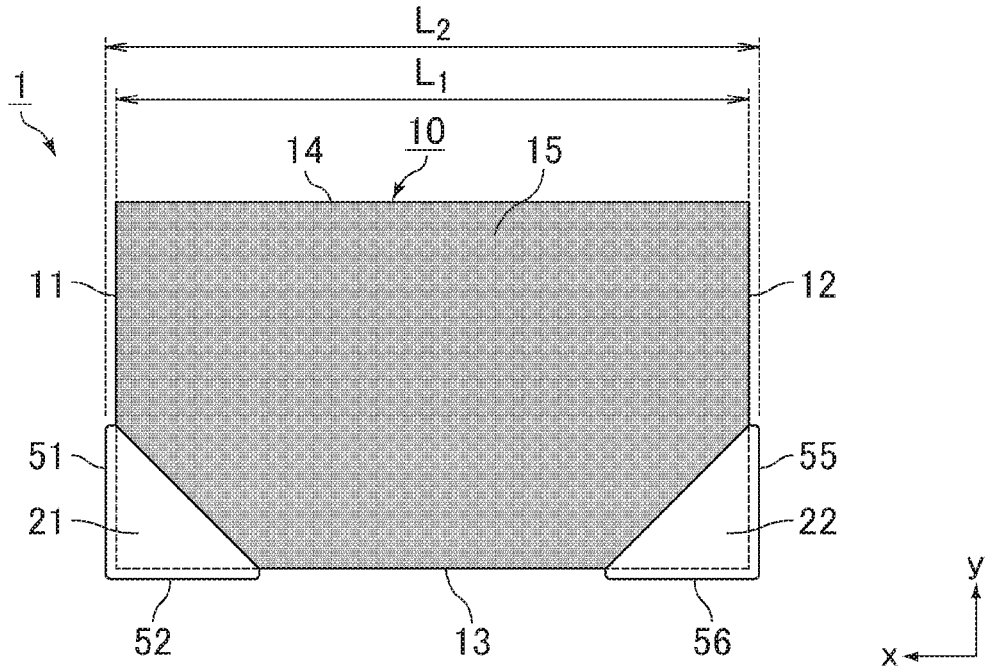
FIG. 4 is a schematic plan view of the multilayer coil component illustrated in FIG. 1 as seen from a first lateral surface.
Figure 5:
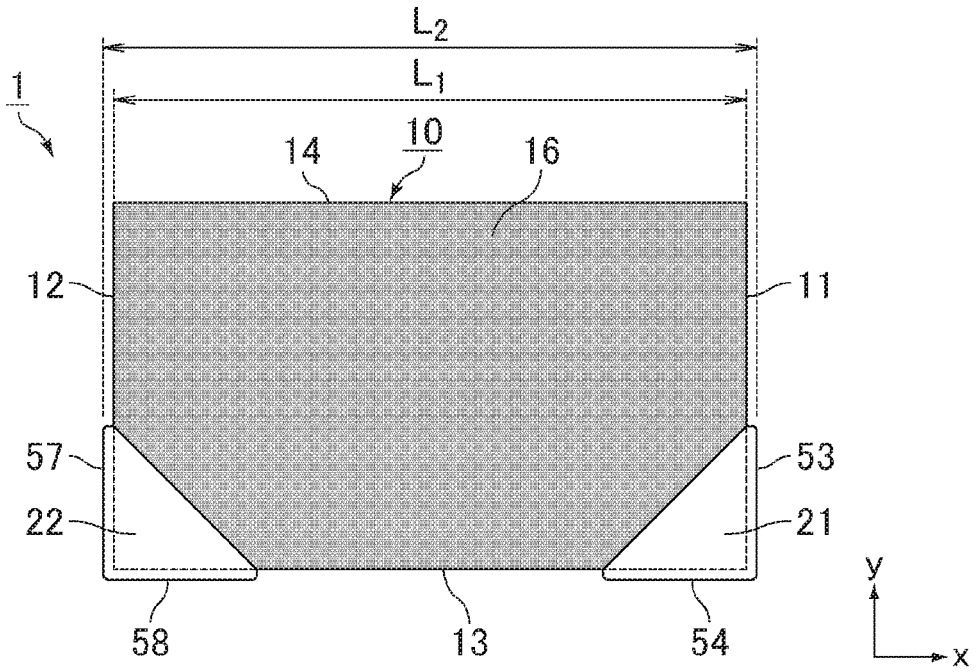
FIG. 5 is a schematic plan view of the multilayer coil component illustrated in FIG. 1 as seen from a second lateral surface.
Figure 6:
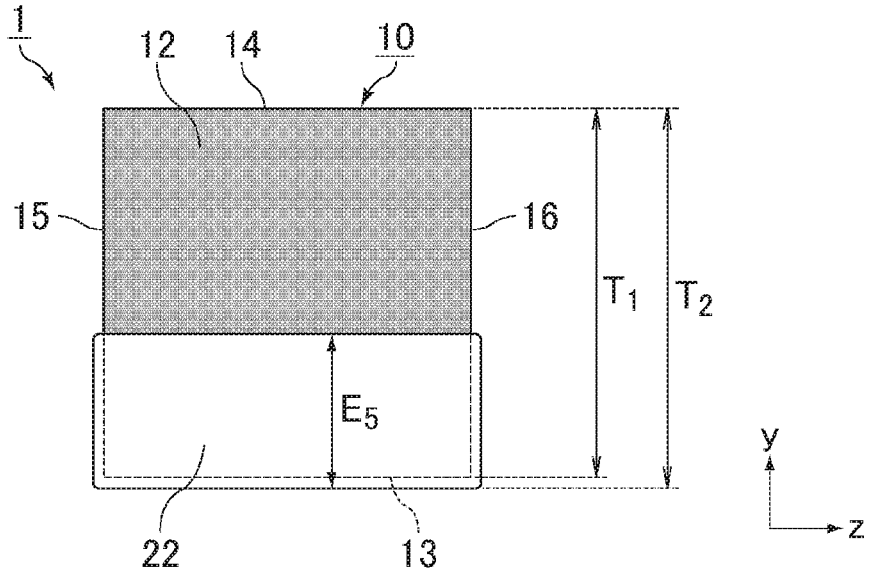
FIG. 6 is a schematic plan view of the multilayer coil component illustrated in FIG. 1 as seen from a second end surface.

FIG. 2 is a schematic plan view of the multilayer coil component illustrated in FIG. 1 as seen from the first end surface. FIG. 3 is a schematic plan view of the multilayer coil component illustrated in FIG. 1 as seen from the first major surface. FIG. 4 is a schematic plan view of the multilayer coil component illustrated in FIG. 1 as seen from the first lateral surface. FIG. 5 is a schematic plan view of the multilayer coil component illustrated in FIG. 1 as seen from the second lateral surface. FIG. 6 is a schematic plan view of the multilayer coil component illustrated in FIG. 1 as seen from the second end surface.

As illustrated in FIGS. 1, 2, and 3, the first outer electrode 21 extends to cover a portion of the first end surface 11 and a portion of the first major surface 13.

As illustrated in FIG. 2, the first outer electrode 21 covers a region of the first end surface 11 including the edge that meets the first major surface 13, and does not cover a region of the first end surface 11 including the edge that meets the second major surface 14. The first end surface 11 is thus exposed in the region including the edge that meets the second major surface 14.

Although a portion of the first outer electrode 21 that covers the first end surface 11 has a height dimension (dimension in the height direction) $E_2$ that is constant in FIG. 2, the height dimension $E_2$ may not be constant. For example, as viewed in plan in the length direction, the first outer electrode 21 may have a substantially chevron shape with the height dimension $E_2$ that increases from its each widthwise end portion toward the central portion.

As illustrated in FIG. 3, the first outer electrode 21 covers a region of the first major surface 13 including the edge that meets the first end surface 11, and does not cover a region of the first major surface 13 including the edge that meets the second end surface 12.

Although a portion of the first outer electrode 21 that covers the first major surface 13 has a length dimension (dimension in the length direction) $E_1$ that is constant in FIG. 3, the length dimension $E_1$ may not be constant. For example, as viewed in plan in the length direction, the first outer electrode 21 may have a substantially chevron shape with the length dimension $E_1$ that increases from its each widthwise end portion toward the central portion.

As described above, the first outer electrode 21 is disposed so as to cover a portion of the first major surface 13 serving as the mounting surface. This configuration improves the mountability of the multilayer coil component 1.

As illustrated in FIGS. 1, 4, and 5, the first outer electrode 21 may extend to cover not only a portion of the first end surface 11 and a portion of the first major surface 13, but also a portion of the first lateral surface 15 and a portion of the second lateral surface 16. More specifically, the first outer electrode 21 may cover a region of the first lateral surface 15 including the vertex that meets the first end surface 11 and the first major surface 13, and may not cover a region of the first lateral surface 15 including the vertex that meets the first end surface 11 and the second major surface 14. Further, the first outer electrode 21 may cover a region of the second lateral surface 16 including the vertex that meets the first end surface 11 and the first major surface 13, and may not cover a region of the second lateral surface 16 including the vertex that meets the first end surface 11 and the second major surface 14.

As illustrated in FIG. 4, the contours of a portion of the first outer electrode 21 that covers the first lateral surface 15 preferably include not only a first edge 51 facing the edge where the first end surface 11 and the first lateral surface 15 meet, and a second edge 52 facing the edge where the first major surface 13 and the first lateral surface 15 meet, but also a line that is oblique to the first and second edges 51 and 52.

As illustrated in FIG. 5, the contours of a portion of the first outer electrode 21 that covers the second lateral surface 16 preferably include not only a third edge 53 facing the edge where the first end surface 11 and the second lateral surface 16 meet, and a fourth edge 54 facing the edge where the first major surface 13 and the second lateral surface 16 meet, but also a line that is oblique to the third and fourth edges 53 and 54.

The first outer electrode 21 may not cover a portion of the first lateral surface 15 and a portion of the second lateral surface 16.

As illustrated in FIGS. 1, 3, and 6, the second outer electrode 22 extends to cover a portion of the second end surface 12 and a portion of the first major surface 13.

As illustrated in FIG. 6, the second outer electrode 22 covers a region of the second end surface 12 including the edge that meets the first major surface 13, and does not cover a region of the second end surface 12 including the edge that meets the second major surface 14. The second end surface 12 is thus exposed in the region including the edge that meets the second major surface 14.

Although a portion of the second outer electrode 22 that covers the second end surface 12 has a height dimension (dimension in the height direction) $E_5$ that is constant in FIG. 6, the height dimension $E_5$ may not be constant. For example, as viewed in plan in the length direction, the second outer electrode 22 may have a substantially chevron shape with the height dimension $E_5$ that increases from its each widthwise end portion toward the central portion.

As illustrated in FIG. 3, the second outer electrode 22 covers a region of the first major surface 13 including the edge that meets the second end surface 12, and does not cover a region of the first major surface 13 including the edge that meets the first end surface 11.

Although a portion of the second outer electrode 22 that covers the first major surface 13 has a length dimension (dimension in the length direction) $E_4$ that is constant in FIG. 3, the length dimension $E_4$ may not be constant. For example, as viewed in plan in the height direction, the second outer electrode 22 may have a substantially chevron shape with the length dimension $E_4$ that increases from its each widthwise end portion toward the central portion.

As described above, the second outer electrode 22 is disposed so as to cover a portion of the first major surface 13 serving as the mounting surface. This configuration improves the mountability of the multilayer coil component 1.

As illustrated in FIGS. 1, 4, and 5, the second outer electrode 22 may extend to cover not only a portion of the second end surface 12 and a portion of the first major surface 13, but also a portion of the first lateral surface 15 and a portion of the second lateral surface 16. More specifically, the second outer electrode 22 may cover a region of the first lateral surface 15 including the vertex that meets the second end surface 12 and the first major surface 13, and may not cover a region of the first lateral surface 15 including the vertex that meets the second end surface 12 and the second major surface 14. Further, the second outer electrode 22 may cover a region of the second lateral surface 16 including the vertex that meets the second end surface 12 and the first major surface 13, and may not cover a region of the second lateral surface 16 including the vertex that meets the second end surface 12 and the second major surface 14.

As illustrated in FIG. 4, the contours of a portion of the second outer electrode 22 that covers the first lateral surface 15 preferably include not only a fifth edge 55 facing the edge where the second end surface 12 and the first lateral surface 15 meet, and a sixth edge 56 facing the edge where the first major surface 13 and the first lateral surface 15 meet, but also a line that is oblique to the fifth and sixth edges 55 and 56.

As illustrated in FIG. 5, the contours of a portion of the second outer electrode 22 that covers the second lateral surface 16 preferably include not only a seventh edge 57 facing the edge where the second end surface 12 and the second lateral surface 16 meet, and an eighth edge 58 facing the edge where the first major surface 13 and the second lateral surface 16 meet, but also a line that is oblique to the seventh and eighth edges 57 and 58.

The second outer electrode 22 may not cover a portion of the first lateral surface 15 and a portion of the second lateral surface 16.

Preferred dimensions of the multilayer coil component 1, the multilayer body 10, the first outer electrode 21, and the second outer electrode 22 will be described below.

Although the multilayer coil component according to the present disclosure is not limited to a particular size, the multilayer coil component is preferably 0603, 0402, or 1005 in size.

(1) Multilayer Coil Component 1 of 0603 Size

A length dimension $L_2$ (dimension in the length direction in FIGS. 4 and 5) of the multilayer coil component 1 is preferably not less than about 0.57 mm. Further, the length dimension $L_2$ of the multilayer coil component 1 is preferably not more than about 0.63 mm (i.e., the length dimension $L_2$ is from about 0.57 mm to about 0.63).

A width dimension $W_2$ (dimension in the width direction in FIG. 3) of the multilayer coil component 1 is preferably not less than about 0.27 mm. Further, the width dimension $W_2$ of the multilayer coil component 1 is preferably not more than about 0.33 mm (i.e., the width dimension $W_2$ is from about 0.27 mm to about 0.33).

A height dimension $T_2$ (dimension in the height direction in FIG. 2) of the multilayer coil component 1 is preferably not less than about 0.27 mm. Further, the height dimension $T_2$ of the multilayer coil component 1 is preferably not more than about 0.33 mm (i.e., the height dimension $T_2$ is from about 0.27 mm to about 0.23).

A length dimension $L_1$ (dimension in the length direction in FIGS. 4 and 5) of the multilayer body 10 is preferably not less than about 0.57 mm. Further, the length dimension $L_1$ of the multilayer body 10 is preferably not more than about 0.63 mm (i.e., the length dimension $L_1$ is from about 0.57 mm to about 0.63).

A width dimension $W_1$ (dimension in the width direction in FIG. 3) of the multilayer body 10 is preferably not less than about 0.27 mm. Further, the width dimension $W_1$ of the multilayer body 10 is preferably not more than about 0.33 mm (i.e., the width dimension $W_1$ is from about 0.27 mm to about 0.33).

A height dimension $T_1$ (dimension in the height direction in FIG. 2) of the multilayer body 10 is preferably not less than about 0.27 mm. Further, the height dimension $T_1$ of the multilayer body 10 is preferably not more than about 0.33 mm (i.e., the height dimension $T_1$ is from about 0.27 mm to about 0.33).

The height dimension $E_2$ of a portion of the first outer electrode 21 that covers the first end surface 11 is preferably not less than about 0.10 mm and not more than about 0.20 mm (i.e., from about 01.0 mm to about 0.20 mm). If the height dimension $E_2$ is not constant, the maximum height dimension is preferably within the above-mentioned range.

The length dimension (dimension in the length direction in FIG. 3) $E_1$ of a portion of the first outer electrode 21 that covers the first major surface 13 is preferably not less than about 0.12 mm and not more than about 0.22 mm (i.e., from about 0.12 to about 0.22 mm). If the length dimension $E_1$ is not constant, the maximum length dimension is preferably within the above-mentioned range.

The height dimension (dimension in the height direction in FIG. 6) $E_5$ of a portion of the second outer electrode 22 that covers the second end surface 12 is preferably not less than about 0.10 mm and not more than about 0.20 mm (i.e., from about 0.10 mm to about 0.20 mm). If the height dimension $E_5$ is not constant, the maximum height dimension is preferably within the above-mentioned range.

The length dimension (dimension in the length direction in FIG. 3) $E_4$ of a portion of the second outer electrode 22 that covers the first major surface 13 is preferably not less than about 0.12 mm and not more than about 0.22 mm (i.e., from about 0.12 mm to about 0.22 mm). If the length dimension $E_4$ is not constant, the maximum length dimension is preferably within the above-mentioned range.

(2) Multilayer Coil Component 1 of 0402 Size

The length dimension $L_2$ of the multilayer coil component 1 is preferably not less than about 0.38 mm. Further, the length dimension $L_2$ of the multilayer coil component 1 is preferably not more than about 0.42 mm (i.e., the length dimension $L_2$ is from about 0.38 mm to about 0.42).

The width dimension $W_2$ of the multilayer coil component 1 is preferably not less than about 0.18 mm. Further, the width dimension $W_2$ of the multilayer coil component 1 is preferably not more than about 0.22 mm (i.e., the width dimension $W_2$ is from about 0.18 mm to about 0.22 mm).

The height dimension $T_2$ of the multilayer coil component 1 is preferably not less than about 0.18 mm. Further, the height dimension $T_2$ of the multilayer coil component 1 is preferably not more than about 0.22 mm (i.e., the height dimension $T_2$ is from about 0.18 mm to about 0.22 mm).

The length dimension $L_1$ of the multilayer body 10 is preferably no less than about 0.38 mm and not more than about 0.42 mm (i.e., from about 0.38 mm to about 0.42 mm).

The width dimension $W_1$ of the multilayer body 10 is preferably not less than about 0.18 mm and not more than about 0.22 mm (i.e., from about 0.18 mm to about 0.22 mm).

The height dimension $T_1$ of the multilayer body 10 is preferably not less than about 0.18 mm and not more than about 0.22 mm (i.e., from about 0.18 mm to about 0.22 mm).

The height dimension $E_2$ of a portion of the first outer electrode 21 that covers the first end surface 11 is preferably not less than about 0.06 mm and not more than about 0.13 mm (i.e., from about 0.06 mm to about 0.13 mm). If the height dimension $E_2$ is not constant, the maximum height dimension is preferably within the above-mentioned range.

The length dimension $E_1$ of a portion of the first outer electrode 21 that covers the first major surface 13 is preferably not less than about 0.08 mm and not more than about 0.15 mm (i.e., from about 0.08 mm to about 0.15 mm). If the length dimension $E_1$ is not constant, the maximum length dimension is preferably within the above-mentioned range.

The height dimension $E_5$ of a portion of the second outer electrode 22 that covers the second end surface 12 is preferably not less than about 0.06 mm and not more than about 0.13 mm (i.e., from about 0.06 mm to about 0.13 mm). If the height dimension $E_5$ is not constant, the maximum height dimension is preferably within the above-mentioned range.

The length dimension $E_4$ of a portion of the second outer electrode 22 that covers the first major surface 13 is preferably not less than about 0.08 mm and not more than about 0.15 mm (i.e., from about 0.08 mm to about 0.15 mm). If the length dimension $E_4$ is not constant, the maximum length dimension is preferably within the above-mentioned range.

(3) Multilayer Coil Component 1 of 1005 Size

The length dimension $L_2$ of the multilayer coil component 1 is preferably not less than about 0.95 mm. Further, the length dimension $L_2$ of the multilayer coil component 1 is preferably not more than about 1.05 mm (i.e., the length dimension $L_2$ is from about 0.95 mm to about 1.05 mm).

The width dimension $W_2$ of the multilayer coil component 1 is preferably not less than about 0.45 mm. Further, the width dimension $W_2$ of the multilayer coil component 1 is preferably not more than about 0.55 mm (i.e., the width dimension $W_2$ is from about 0.45 mm to about 0.55 mm).

The height dimension $T_2$ of the multilayer coil component 1 is preferably not less than about 0.45 mm. Further, the height dimension $T_2$ of the multilayer coil component 1 is preferably not more than about 0.55 mm (i.e., the height dimension $T_2$ is from about 0.45 mm to about 0.55 mm).

The length dimension $L_1$ of the multilayer body 10 is preferably not less than about 0.95 mm and not more than about 1.05 mm (i.e., from about 0.95 mm to about 1.05 mm).

The width dimension $W_1$ of the multilayer body 10 is preferably not less than about 0.45 mm and not more than about 0.55 mm (i.e., from about 0.45 mm to about 0.55 mm).

The height dimension $T_1$ of the multilayer body 10 is preferably not less than about 0.45 mm and not more than about 0.55 mm (i.e., from about 0.45 mm to about 0.55 mm).

The height dimension $E_2$ of a portion of the first outer electrode 21 that covers the first end surface 11 is preferably not less than about 0.15 mm and not more than about 0.33 mm (i.e., from about 0.15 mm to about 0.33 mm). If the height dimension $E_2$ is not constant, the maximum height dimension is preferably within the above-mentioned range.

The length dimension $E_1$ of a portion of the first outer electrode 21 that covers the first major surface 13 is preferably not less than about 0.20 mm and not more than about 0.38 mm (i.e., from about 0.20 mm to about 0.38 mm). If the length dimension $E_1$ is not constant, the maximum length dimension is preferably within the above-mentioned range.

The height dimension $E_5$ of a portion of the second outer electrode 22 that covers the second end surface 12 is preferably not less than about 0.15 mm and not more than about 0.33 mm (i.e., from about 0.15 mm to about 0.33 mm). If the height dimension $E_5$ is not constant, the maximum height dimension is preferably within the above-mentioned range.

The length dimension $E_4$ of a portion of the second outer electrode 22 that covers the first major surface 13 is preferably not less than about 0.20 mm and not more than about 0.38 mm (i.e., from about 0.22 mm to about 0.38 mm). If the length dimension $E_4$ is not constant, the maximum length dimension is preferably within the above-mentioned range.

Figure 7:
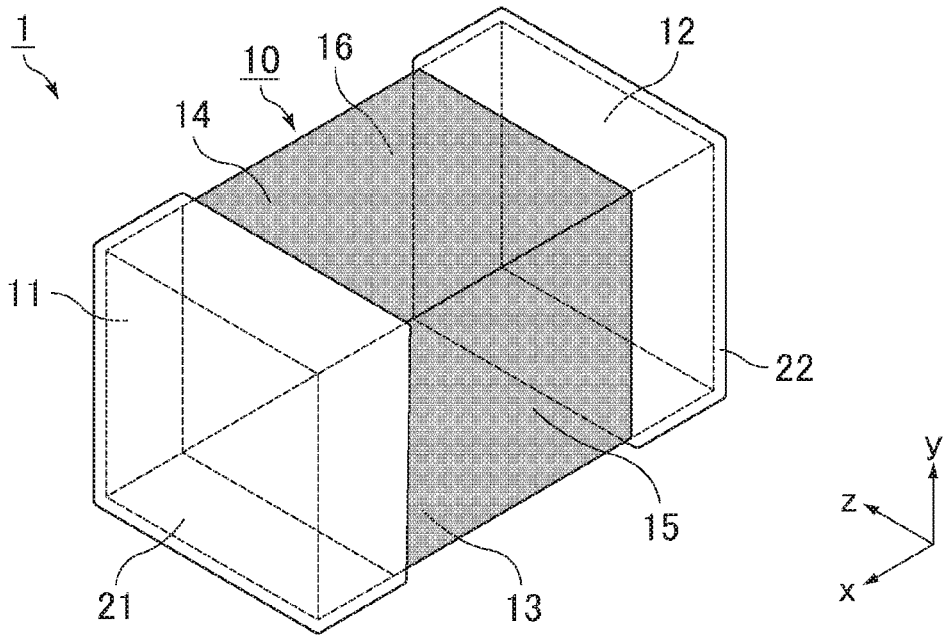
FIG. 7 is a schematic perspective view of another exemplary multilayer coil component according to the present disclosure.

Although each of the first and second outer electrodes 21 and 22 does not cover the second major surface 14 in FIG. 1, each of the first and second outer electrodes 21 and 22 may cover the second major surface 14 as illustrated in FIG. 7. FIG. 7 is a schematic perspective view of another exemplary multilayer coil component according to the present disclosure. As illustrated in FIG. 7, the first outer electrode 21 extends to cover the entire first end surface 11, a portion of the first major surface 13, a portion of the second major surface 14, a portion of the first lateral surface 15, and a portion of the second lateral surface 16. The second outer electrode 22 extends to cover the entire second end surface 12, a portion of the first major surface 13, a portion of the second major surface 14, a portion of the first lateral surface 15, and a portion of the second lateral surface 16.

The multilayer coil component 1 illustrated in FIG. 1 will be described below in more detail.

Figure 8:
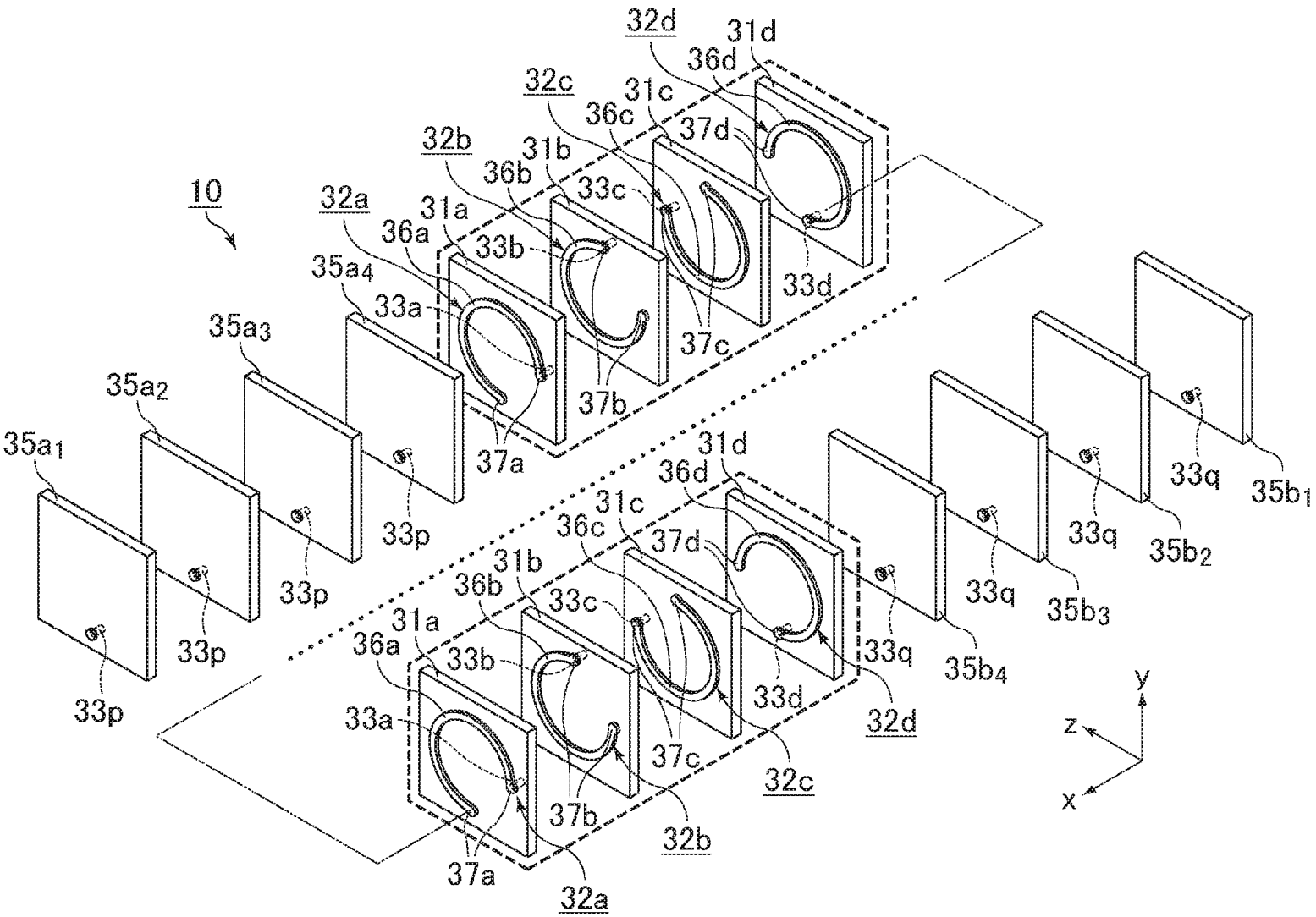
FIG. 8 is an exploded schematic perspective view of an exemplary multilayer body constituting the multilayer coil component illustrated in FIG. 1.
Figure 9:
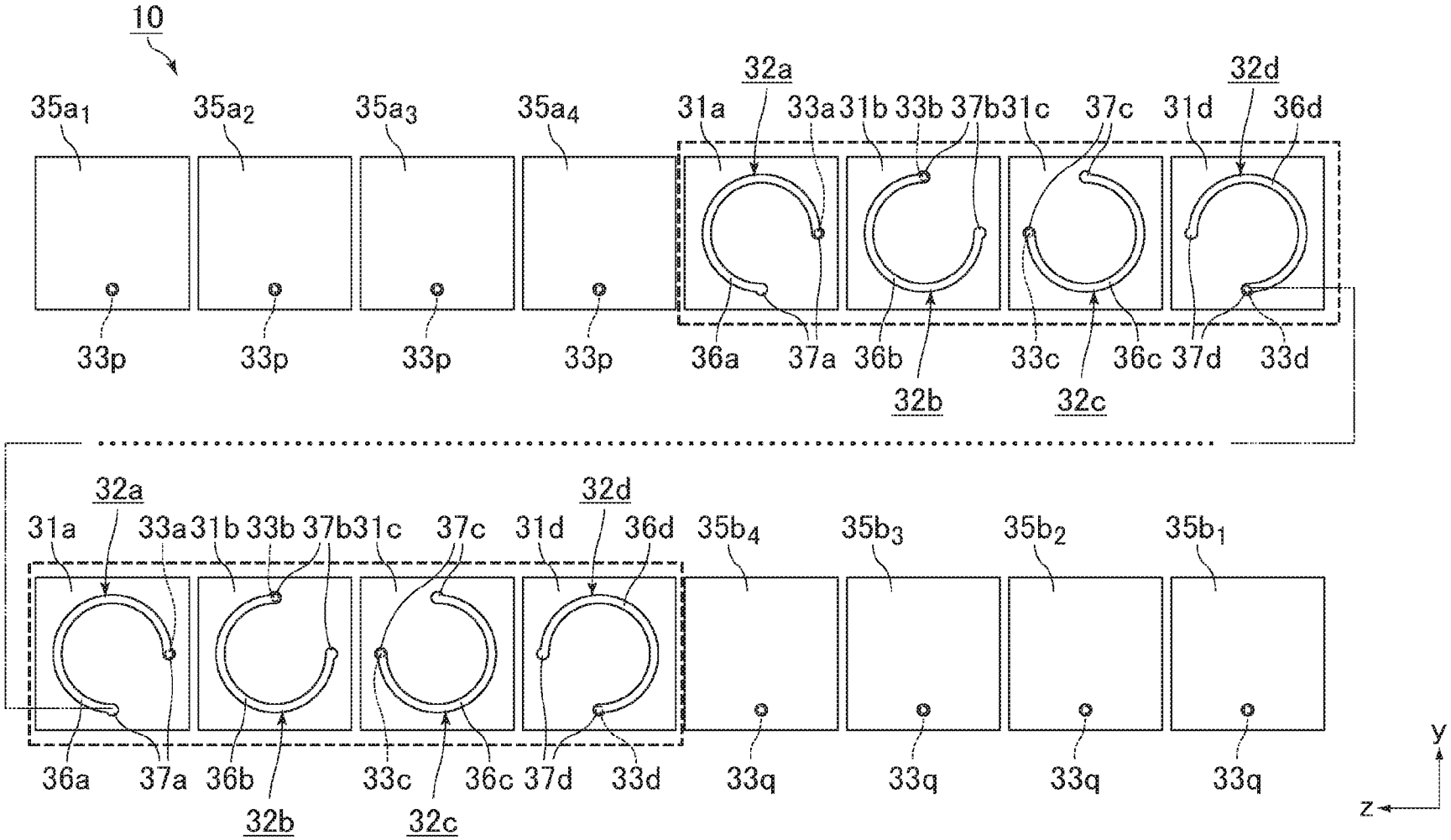
FIG. 9 is an exploded schematic plan view of the exemplary multilayer body constituting the multilayer coil component illustrated in FIG. 1.

FIG. 8 is an exploded schematic perspective view of an exemplary multilayer body constituting the multilayer coil component illustrated in FIG. 1. FIG. 9 is an exploded schematic plan view of the exemplary multilayer body constituting the multilayer coil component illustrated in FIG. 1.

As illustrated in FIGS. 8 and 9, the multilayer body 10 is formed by stacking the following insulating layers in the length direction: an insulating layer 35$a_1$, an insulating layer 35$a_2$, an insulating layer 35$a_3$, an insulating layer 35$a_4$, an insulating layer 31*a*, an insulating layer 31*b*, an insulating layer 31*c*, an insulating layer 31*d*, an insulating layer 35$b_4$, an insulating layer 35$b_3$, an insulating layer 35$b_2$, and an insulating layer 35$b_1$.

A coil conductor 32*a*, a coil conductor 32*b*, a coil conductor 32*c*, and a coil conductor 32*d* are respectively disposed on the major surfaces of the insulating layer 31*a*, the insulating layer 31*b*, the insulating layer 31*c*, and the insulating layer 31*d*. The coil conductor 32*a*, the coil conductor 32*b*, the coil conductor 32*c*, and the coil conductor 32*d* are respectively stacked in the length direction together with the insulating layer 31*a*, the insulating layer 31*b*, the insulating layer 31*c*, and the insulating layer 31*d*. These coil conductors are electrically connected to form the coil.

The stacking direction of the multilayer body 10 (the direction in which the insulating layers and the coil conductors are stacked) corresponds to the length direction.

The coil conductor 32*a*, the coil conductor 32*b*, the coil conductor 32*c*, and the coil conductor 32*d* each have a length equal to a three-quarter turn of the coil. In other words, the number of stacked coil conductors that form three turns of the coil is four. For the multilayer body 10, the coil conductor 32*a*, the coil conductor 32*b*, the coil conductor 32*c*, and the coil conductor 32*d* together constitute a single unit (equivalent to three turns), and such single units are repeatedly stacked.

The coil conductor 32*a* has a line portion 36*a*, and a land portion 37*a* disposed in each end portion of the line portion 36*a*. The coil conductor 32*b* has a line portion 36*b*, and a land portion 37*b* disposed in each end portion of the line portion 36*b*. The coil conductor 32*c* has a line portion 36*c*, and a land portion 37*c* disposed in each end portion of the line portion 36*c*. The coil conductor 32*d* has a line portion 36*d*, and a land portion 37*d* disposed in each end portion of the line portion 36*d*.

The insulating layer 31*a*, the insulating layer 31*b*, the insulating layer 31*c*, and the insulating layer 31*d* are respectively provided with a via conductor 33*a*, a via conductor 33*b*, a via conductor 33*c*, and a via conductor 33*d*, which are each disposed so as to penetrate the corresponding insulating layer in the stacking direction.

The insulating layer 31*a* provided with the coil conductor 32*a* and the via conductor 33*a*, the insulating layer 31*b* provided with the coil conductor 32*b* and the via conductor 33*b*, the insulating layer 31*c* provided with the coil conductor 32*c* and the via conductor 33*c*, and the insulating layer 31*d* provided with the coil conductor 32*d* and the via conductor 33*d* together constitute a single unit (the portion bounded by dashed lines in FIGS. 8 and 9), and such single units are repeatedly stacked. Thus, the land portion 37*a* of the coil conductor 32*a*, the land portion 37*b* of the coil conductor 32*b*, the land portion 37*c* of the coil conductor 32*c*, and the land portion 37*d* of the coil conductor 32*d* are connected by the via conductor 33*a*, the via conductor 33*b*, the via conductor 33*c*, and the via conductor 33*d*. In other words, the respective land portions of coil conductors that are adjacent to each other in the stacking direction are connected with each other by a via conductor.

The coil having a substantially solenoid shape and incorporated in the multilayer body 10 is thus formed as described above.

As illustrated in FIG. 9, as viewed in plan in the stacking direction, the land portion of each of the coil conductor 32*a*, the coil conductor 32*b*, the coil conductor 32*c*, and the coil conductor 32*d* is not located inside the inner periphery of the line portion, and partially overlaps the line portion. The above-mentioned positional relationship between the line and land portions of each coil conductor ensures that the coil diameter (inside diameter) of the coil conductor does not decrease even at the position where the land portion is located, and thus a large impedance is obtained in the radio frequency range.

Figure 10:
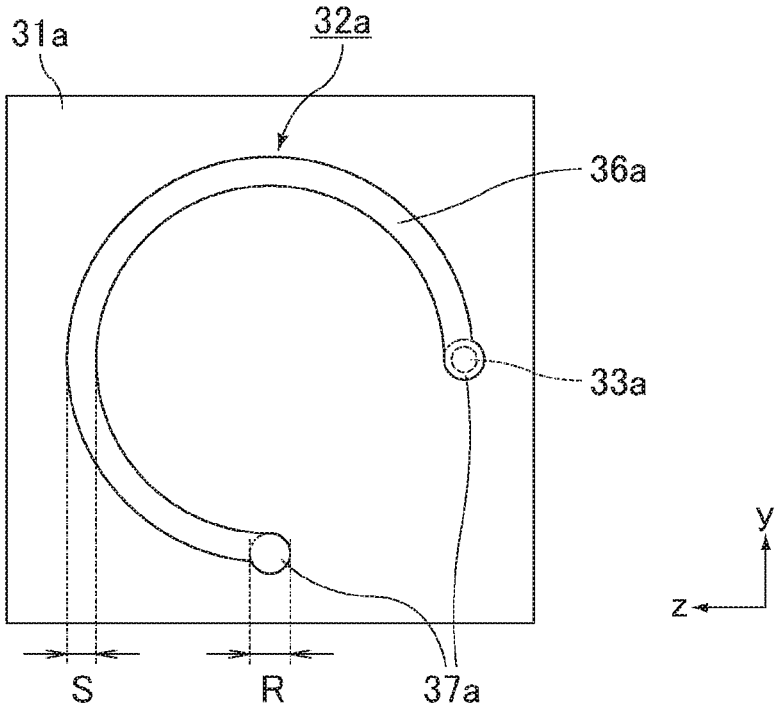
FIG. 10 is a schematic plan view of an insulating layer illustrated in FIG. 9 that is provided with a coil conductor and a via conductor.

FIG. 10 is a schematic plan view of an insulating layer illustrated in FIG. 9 that is provided with a coil conductor and a via conductor. As illustrated in FIG. 10, as viewed in plan in the stacking direction, the land portion 37*a* of the coil conductor 32*a* has a diameter R of not less than about 1.05 times and not more than about 1.3 times (i.e., from about 1.05 times to about 1.3 times) a line width S of the line portion 36*a*. If the diameter R of the land portion 37*a* is less than about 1.05 times the line width S of the line portion 36*a*, this leads to inadequate connection between the land portion 37*a* and the via conductor 33*a*, which in turn results in inadequate connection between the land portion 37*a* and the land portion 37*b* that are adjacent to each other in the stacking direction. If the diameter R of the land portion 37*a* is more than about 1.3 times the line width S of the line portion 36*a*, this leads to increased stray capacitance due to the land portion 37*a*, causing degradation of the radio frequency characteristics of the multilayer coil component 1. Likewise, for each of the coil conductor 32*b*, the coil conductor 32*c*, and the coil conductor 32*d* as well, its land portion has a diameter of not less than about 1.05 times and not more than about 1.3 times (i.e., from about 1.05 times to about 1.3 times) the line width of the line portion.

Therefore, the multilayer coil component 1 exhibits a large impedance in the radio frequency range, and thus has improved radio frequency characteristics. As for the radio frequency characteristics of the multilayer coil component 1 in the radio frequency range (in particular, from about 30 GHz or above to about 80 GHz or below (i.e., from about 30 GHz to about 80 GHz)), the transmission coefficient S21 at about 40 GHz is preferably not less than about −1 dB and not more than about 0 dB (i.e., from about −1 dB to about 0 dB), and the transmission coefficient S21 at about 50 GHz is preferably not less than about −2 dB and not more than about 0 dB (i.e., from about −2 dB to about 0 dB). If the multilayer coil component 1 satisfies the above-mentioned condition, the multilayer coil component 1 can be suitably employed for, for example, a bias-tee circuit within an optical communication circuit. The transmission coefficient S21 is calculated as the ratio of the power of a transmitted signal to the power of an input signal. The transmission coefficient S21 at each individual frequency is determined by using, for example, a network analyzer. Although the transmission coefficient S21 is basically a dimensionless quantity, the transmission coefficient S21 is normally represented in units of dB by taking its common logarithm.

As viewed in plan in the stacking direction, the line width S of the line portion 36*a* of the coil conductor 32*a* is preferably not less than about 30 μm and not more than about 80 μm (i.e., from about 30 μm to about 80 μm), more preferably not less than about 30 μm and not more than about 60 μm (i.e., from about 30 μm to about 60 μm). If the line width S of the line portion 36*a* is less than about 30 μm, this may result in increased direct-current resistance of the coil. If the line width S of the line portion 36*a* is more than about 80 μm, this may result in increased electrostatic capacity of the coil and consequently degraded radio frequency characteristics of the multilayer coil component 1. Likewise, for each of the coil conductor 32*b*, the coil conductor 32*c*, and the coil conductor 32*d* as well, its line portion has a line width of preferably not less than about 30 μm and not more than about 80 μm (i.e., from about 30 μm to about 80 μm), more preferably not less than about 30 μm and not more than about 60 μm (i.e., from about 30 μm to about 60 μm).

As viewed in plan in the stacking direction, for the coil conductor 32*a*, the outer periphery of the land portion 37*a* is preferably in contact with the inner periphery of the line portion 36*a*. This configuration sufficiently reduces the area of the land portion 37*a* that is located outside the outer periphery of the line portion 36*a*, which in turn sufficiently reduces the stray capacitance due to the land portion 37*a*, thus further improving the radio frequency characteristics of the multilayer coil component 1. Likewise, for each of the coil conductor 32*b*, the coil conductor 32*c*, and the coil conductor 32*d* as well, the outer periphery of its land portion is preferably in contact with the inner periphery of the line portion.

As viewed in plan in the stacking direction, the coil including the coil conductor 32*a*, the coil conductor 32*b*, the coil conductor 32*c*, and the coil conductor 32*d* may have a substantially circular shape, or may have a substantially polygonal shape. If the coil has a substantially polygonal shape as viewed in plan in the stacking direction, the diameter of a circle corresponding to the area of the polygonal shape is defined as the coil diameter, and the axis passing through the center of gravity of the polygonal shape and extending in the stacked direction is defined as the coil axis.

As viewed in plan in the stacking direction, each of the land portion 37*a*, the land portion 37*b*, the land portion 37*c*, and the land portion 37*d* may have a substantially circular shape as illustrated in FIG. 9, or may have a substantially polygonal shape. If each of the land portion 37*a*, the land portion 37*b*, the land portion 37*c*, and the land portion 37*d* has a substantially polygonal shape as viewed in plan in the stacking direction, the diameter of the circle corresponding to the area of the polygonal shape is defined as the diameter of the land portion.

As illustrated in FIGS. 8 and 9, each of the insulating layer $\mathbf{35}a_1$, the insulating layer $\mathbf{35}a_2$, the insulating layer $\mathbf{35}a_3$, and the insulating layer $\mathbf{35}a_4$ is provided with a via conductor 33*p* disposed so as to penetrate the insulating layer. A land portion connected to the via conductor 33*p* may be disposed on the major surface of each of the insulating layer $\mathbf{35}a_1$, the insulating layer $\mathbf{35}a_2$, the insulating layer $\mathbf{35}a_3$, and the insulating layer $\mathbf{35}a_4$.

The insulating layer $\mathbf{35}a_1$ provided with the via conductor 33*p*, the insulating layer $\mathbf{35}a_2$ provided with the via conductor 33*p*, the insulating layer $\mathbf{35}a_3$ provided with the via conductor 33*p*, and the insulating layer $\mathbf{35}a_4$ provided with the via conductor 33*p* are stacked so as to overlap the insulating layer 31*a* that is provided with the coil conductor 32*a* and the via conductor 33*a*. The via conductors 33*p* thus connect with each other to form a first connecting conductor 41, and the first connecting conductor 41 is exposed on the first end surface 11. As a result, the first outer electrode 21 and the coil conductor 32*a* are connected with each other by the first connecting conductor 41.

As illustrated in FIGS. 8 and 9, each of the insulating layer $\mathbf{35}b_1$, the insulating layer $\mathbf{35}b_2$, the insulating layer $\mathbf{35}b_3$, and the insulating layer $\mathbf{35}b_4$ is provided with a via conductor 33*q* disposed so as to penetrate the insulating layer. A land portion connected to the via conductor 33*q* may be disposed on the major surface of each of the insulating layer $\mathbf{35}b_1$, the insulating layer $\mathbf{35}b_2$, the insulating layer $\mathbf{35}b_3$, and the insulating layer $\mathbf{35}b_4$.

The insulating layer $\mathbf{35}b_1$ provided with the via conductor 33*q*, the insulating layer $\mathbf{35}b_2$ provided with the via conductor 33*q*, the insulating layer $\mathbf{35}b_3$ provided with the via conductor 33*q*, and the insulating layer $\mathbf{35}b_4$ provided with the via conductor 33*q* are stacked so as to overlap the insulating layer 31*d* that is provided with the coil conductor 32*d* and the via conductor 33*d*. The via conductors 33*q* thus connect with each other to form a second connecting conductor 42, and the second connecting conductor 42 is exposed on the second end surface 12. As a result, the second outer electrode 22 and the coil conductor 32*d* are connected with each other by the second connecting conductor 42.

If the via conductors 33*p* constituting the first connecting conductor 41, and the via conductors 33*q* constituting the second connecting conductor 42 are each connected with a land portion, the shape of each of the first and second connecting conductors 41 and 42 in this case means a shape excluding the land portion.

Figure 11:
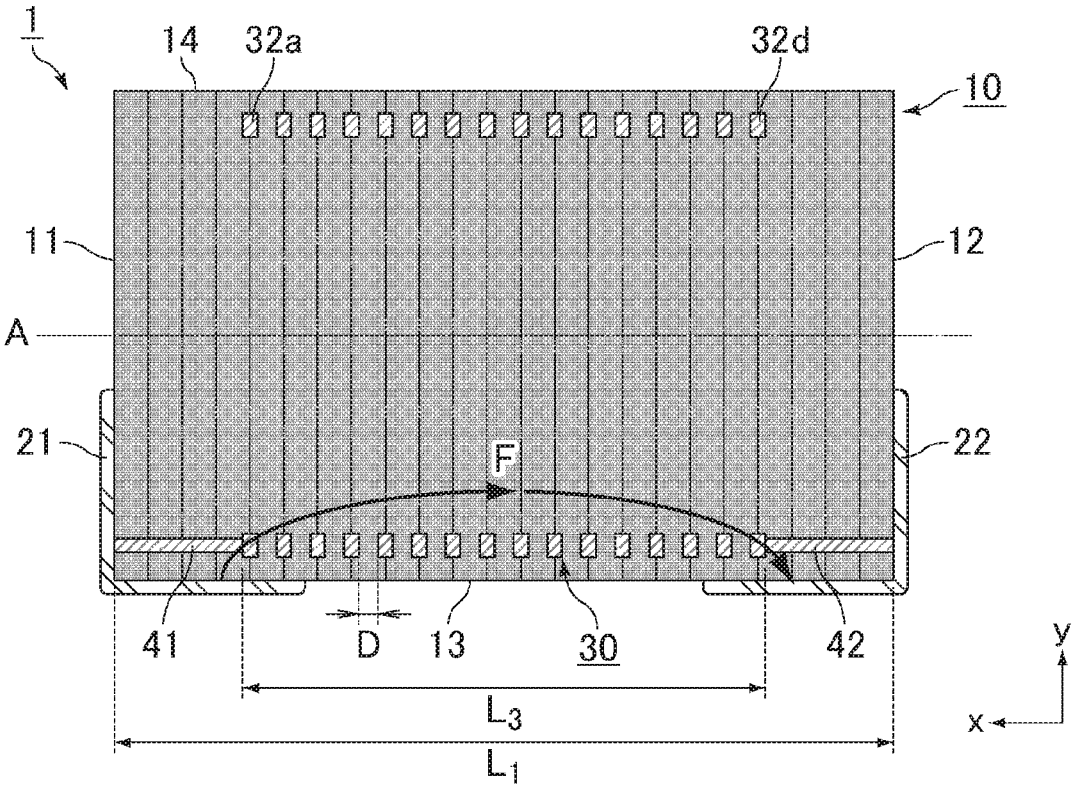
FIG. 11 is a schematic cross-sectional view taken in the length direction of the multilayer coil component illustrated in FIG. 1.

FIG. 11 is a schematic cross-sectional view taken in the length direction of the multilayer coil component illustrated in FIG. 1. As illustrated in FIG. 11, the multilayer body 10 is formed by stacking plural insulating layers as illustrated in FIGS. 8 and 9 in the length direction. Although the boundaries between these insulating layers are indicated by dashed lines in FIG. 11 for the convenience of illustration, these boundaries may not appear clearly in actuality.

The multilayer body 10 includes a coil 30 incorporated therein. The coil 30 is formed by electrically connecting plural coil conductors as illustrated in FIGS. 8 and 9. FIG. 11 does not precisely depict the shape of the coil 30, the location of each coil conductor, the connection between the coil conductors, and other details. For example, coil conductors that are adjacent to each other in the stacking direction are connected with each other by a via conductor as described above.

The coil 30 has a coil axis A. The coil axis A extends in the stacking direction, and penetrates the area between the first end surface 11 and the second end surface 12. The stacking direction, and the direction of the coil axis A are parallel to the first major surface 13 serving as the mounting surface.

The first outer electrode 21 and the coil 30 are connected with each other by the first connecting conductor 41. More specifically, the first outer electrode 21, and the coil conductor 32*a* facing the first outer electrode 21 are connected with each other by the first connecting conductor 41.

The first connecting conductor 41 preferably connects the first outer electrode 21 and the coil 30 (coil conductor 32*a*) in a substantially linear manner. Further, as viewed in plan in the stacking direction, preferably, the first connecting conductor 41 overlaps the coil conductor 32*a*, and is located closer to the first major surface 13 serving as the mounting surface than the coil axis A. The above-mentioned configurations facilitate the electrical connection between the first outer electrode 21 and the coil 30.

When it is herein stated that the first connecting conductor 41 connects the first outer electrode 21 and the coil 30 in a substantially linear manner, this means that as viewed in plan in the stacked direction, the via conductors 33*p* constituting the first connecting conductor 41 overlap each other, and does not necessarily mean that the via conductors 33*p* are arranged strictly linearly.

The first connecting conductor 41 is preferably connected to a portion of the coil conductor 32*a* located closest to the first major surface 13. This configuration makes it possible to sufficiently reduce the area of a portion of the first outer electrode 21 that covers the first end surface 11. As a result, the stray capacitance between the coil 30 and the first outer electrode 21 is sufficiently reduced, thus further improving the radio frequency characteristics of the multilayer coil component 1.

Plural first connecting conductors 41 may be disposed. In this case, the first outer electrode 21 (its portion covering the first end surface 11) and the coil 30 (coil conductor 32*a*) are connected with each other at plural locations by the first connecting conductor 41.

The second outer electrode 22 and the coil 30 are connected with each other by the second connecting conductor 42. More specifically, the second outer electrode 22, and the coil conductor 32*d* facing the second outer electrode 22 are connected with each other by the second connecting conductor 42.

The second connecting conductor 42 preferably connects the second outer electrode 22 and the coil 30 (coil conductor 32*d*) in a substantially linear manner. Further, as viewed in plan in the stacking direction, preferably, the second connecting conductor 42 overlaps the coil conductor 32*d*, and is located closer to the first major surface 13 serving as the mounting surface than the coil axis A. The above-mentioned configurations facilitate the electrical connection between the second outer electrode 22 and the coil 30.

When it is herein stated that the second connecting conductor 42 connects the second outer electrode 22 and the coil 30 in a substantially linear manner, this means that as viewed in plan in the stacked direction, the via conductors 33*q* constituting the second connecting conductor 42 overlap each other, and does not necessarily mean that the via conductors 33*q* are arranged strictly linearly.

The second connecting conductor 42 is preferably connected to a portion of the coil conductor 32*d* located closest to the first major surface 13. This configuration makes it possible to sufficiently reduce the area of a portion of the second outer electrode 22 that covers the second end surface 12. As a result, the stray capacitance between the coil 30 and the second outer electrode 22 is sufficiently reduced, thus further improving the radio frequency characteristics of the multilayer coil component 1.

Plural second connecting conductors 42 may be disposed. In this case, the second outer electrode 22 (its portion covering the second end surface 12) and the coil 30 (coil conductor 32*d*) are connected with each other at plural locations by the second connecting conductor 42.

The region where the coil conductors are disposed has a dimension $L_3$ in the stacking direction of preferably not less than about 85% and not more than about 95% (i.e., from about 85% to about 95%), more preferably not less than about 90% and not more than about 95% (i.e., from about 90% and not more than about 95%) of the length dimension $L_1$ of the multilayer body 10. In this regard, the dimension $L_3$ in the stacking direction of the region where the coil conductors are disposed refers to the distance in the stacking direction from the coil conductor 32*a* connected to the first outer electrode 21 by the first connecting conductor 41, to the coil conductor 32*d* connected to the second outer electrode 22 by the second connecting conductor 42 (which distance includes the respective thicknesses of the above-mentioned two coil conductors). If the dimension $L_3$ of the region where the coil conductors are disposed is less than about 85% of the length dimension $L_1$ of the multilayer body 10, this results in increased electrostatic capacity of the coil 30, which may cause degradation of the radio frequency characteristics of the multilayer coil component 1. If the dimension $L_3$ of the region where the coil conductors are disposed is more than about 95% of the length dimension $L_1$ of the multilayer body 10, this results in increased stray capacitance between the coil 30 and each of the first and second outer electrodes 21 and 22, which may cause degradation of the radio frequency characteristics of the multilayer coil component 1.

The number of stacked coil conductors is preferably not less than 40 and not more than 60 (i.e., from 40 to 60). If the number of stacked coil conductors is less than 40, this may result in increased stray capacitance and consequently reduced transmission coefficient S21. If the number of stacked coil conductors is more than 60, this may result in increased direct-current resistance of the coil. If the number of stacked coil conductors is within the above-mentioned range, the radio frequency characteristics of the multilayer coil component 1 further improve.

The distance D between coil conductors that are adjacent to each other in the stacking direction is preferably not less than about 3 μm and not more than about 10 μm (i.e., from about 3 μm to about 10 μm). This configuration helps to increase the number of turns in the coil 30. This results in increased impedance, and also increased transmission coefficient S21 in the radio frequency range. The distance D between coil conductors that are adjacent to each other in the stacking direction means the shortest distance between coil conductors that are connected with each other by a via conductor. As such, the distance D between coil conductors that are adjacent to each other in the stacking direction is not necessarily the same as the distance between coil conductors involved in the generation of a stray capacitance.

Figure 12:
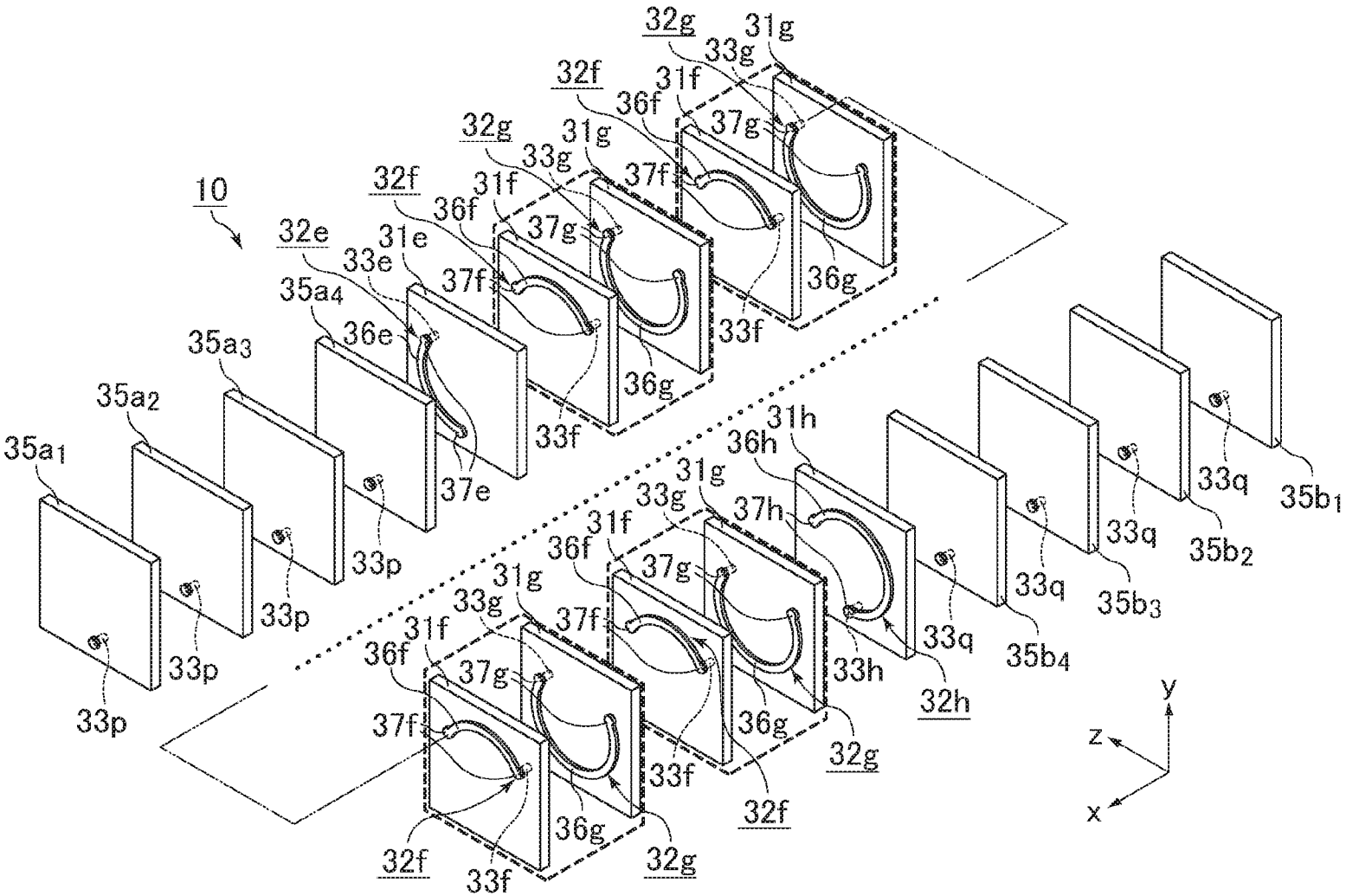
FIG. 12 is an exploded schematic perspective view of another exemplary multilayer body constituting the multilayer coil component illustrated in FIG. 1.
Figure 13:
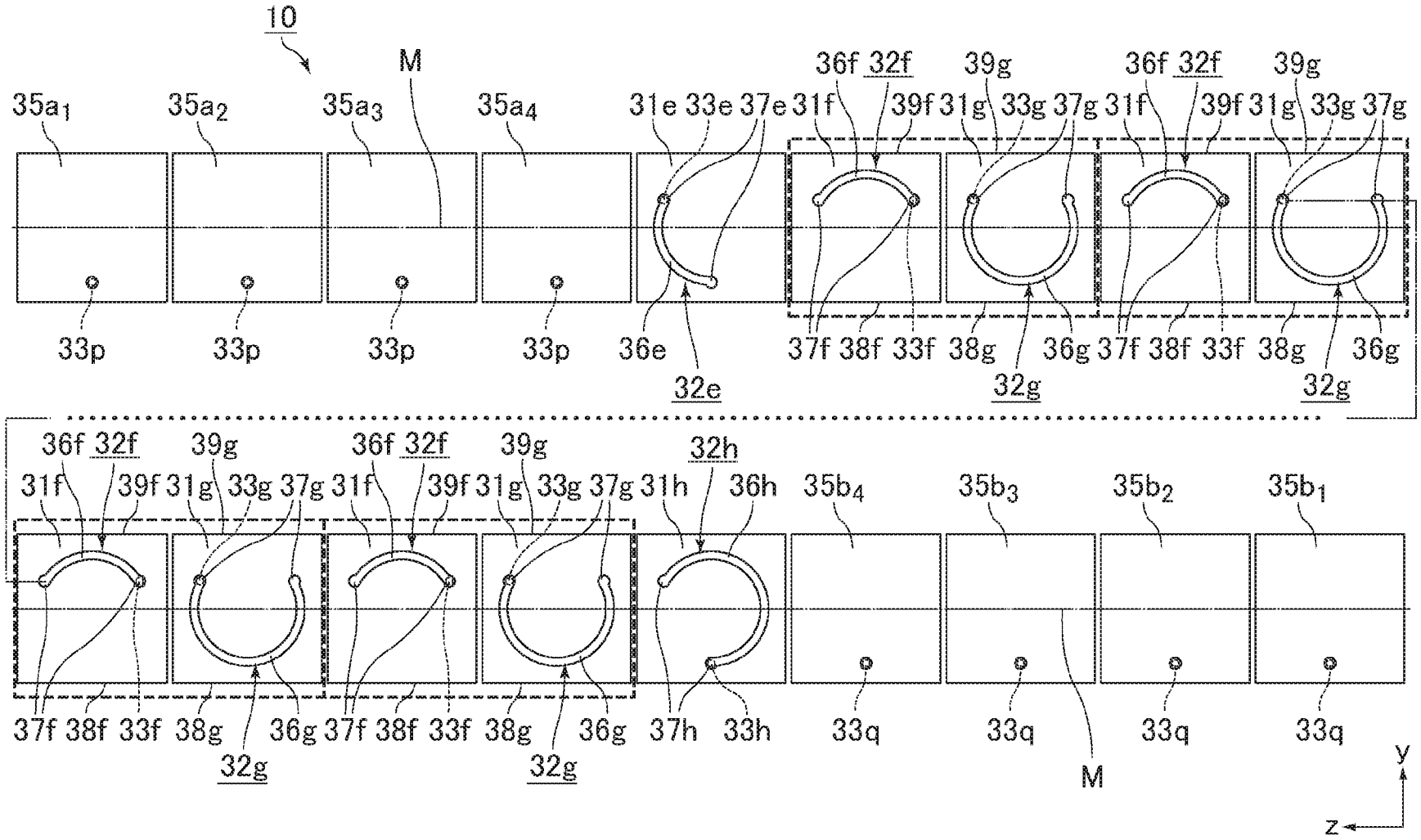
FIG. 13 is an exploded schematic plan view of the other exemplary multilayer body constituting the multilayer coil component illustrated in FIG. 1.

Although FIGS. 8 and 9 depict an exemplary pattern in which the number of stacked coil conductors that form three turns of the coil 30 is four, another pattern may be employed in which the number of stacked coil conductors that form one turn of the coil 30 is two. FIG. 12 is an exploded schematic perspective view of another exemplary multilayer body constituting the multilayer coil component illustrated in FIG. 1. FIG. 13 is an exploded schematic plan view of the other exemplary multilayer body constituting the multilayer coil component illustrated in FIG. 1.

As illustrated in FIGS. 12 and 13, the multilayer body 10 is formed by stacking the following insulating layers in the length direction: the insulating layer 35$a_1$, the insulating layer 35$a_2$, the insulating layer 35$a_3$, the insulating layer 35$a_4$, an insulating layer 31*e*, an insulating layer 31*f*, an insulating layer 31*g*, an insulating layer 31*h*, the insulating layer 35$b_4$, the insulating layer 35$b_3$, the insulating layer 35$b_2$, and the insulating layer 35$b_1$.

A coil conductor 32*e*, a coil conductor 32*f*, a coil conductor 32*g*, and a coil conductor 32*h* are respectively disposed on the major surfaces of the insulating layer 31*e*, the insulating layer 31*f*, the insulating layer 31*g*, and the insulating layer 31*h*. The coil conductor 32*e*, the coil conductor 32*f*, the coil conductor 32*g*, and the coil conductor 32*h* are respectively stacked in the length direction together with the insulating layer 31*e*, the insulating layer 31*f*, the insulating layer 31*g*, and the insulating layer 31*h*. These coil conductors are electrically connected to form the coil.

For the pattern as illustrated in FIGS. 12 and 13, the number of stacked coil conductors that form one turn of the coil 30 is two. For the multilayer body 10, the coil conductor 32*f* and the coil conductor 32*g* together constitute a single unit (equivalent to one turn), and such single units are repeatedly stacked.

The coil conductor 32*e* has a line portion 36*e*, and a land portion 37*e* disposed in each end portion of the line portion 36*e*. The coil conductor 32*f* has a line portion 36*f*, and a land portion 37*f* disposed in each end portion of the line portion 36*f*. The coil conductor 32*g* has a line portion 36*g*, and a land portion 37*g* disposed in each end portion of the line portion 36*g*. The coil conductor 32*h* has a line portion 36*h*, and a land portion 37*h* disposed in each end portion of the line portion 36*h*.

The insulating layer 31*e*, the insulating layer 31*f*, the insulating layer 31*g*, and the insulating layer 31*h* are respectively provided with a via conductor 33*e*, a via conductor 33*f*, a via conductor 33*g*, and a via conductor 33*h*, which are each disposed so as to penetrate the corresponding insulating layer in the stacking direction.

The insulating layer 31*f* provided with the coil conductor 32*f* and the via conductor 33*f*, and the insulating layer 31*g* provided with the coil conductor 32*g* and the via conductor 33*g* together constitute a single unit (the portion bounded by dashed lines in FIGS. 12 and 13), and such single units are repeatedly stacked. Thus, the land portion 37*f* of the coil conductor 32*f*, and the land portion 37*g* of the coil conductor 32*g* are connected by the via conductor 33*f* and the via conductor 33*g*.

As described above, each two coil conductors 32*f* and 32*g* together make up one turn of the coil 30, and with respect to the stacking direction, the respective line portions 36*f* and 36*g* of the coil conductors 32*f* and 32*g* do not face each other with an insulating layer interposed therebetween. As compared with the pattern (three-quarter-turn shape) as illustrated in FIGS. 8 and 9, the above-mentioned pattern results in increased distance between coil conductors involved in the generation of a stray capacitance (the distance between line portions that face each other in the stacking direction, which in FIGS. 12 and 13 corresponds to each of the distance between the line portions 36*f* that face each other in the stacking direction and the distance between the line portions 36*g* that face each other in the stacking direction). This leads to reduced stray capacitance and consequently improved radio frequency characteristics of the multilayer coil component 1.

The insulating layer 31*e* provided with the coil conductor 32*e* and the via conductor 33*e*, and the insulating layer 31*f* provided with the coil conductor 32*f* and the via conductor 33*f* are stacked on each other. Thus, the land portion 37*e* of the coil conductor 32*e*, and the land portion 37*f* of the coil conductor 32*f* are connected by the via conductor 33*e*.

The insulating layer 31*g* provided with the coil conductor 32*g* and the via conductor 33*g*, and the insulating layer 31*h* provided with the coil conductor 32*h* and the via conductor 33*h* are stacked on each other. Thus, the land portion 37*g* of the coil conductor 32*g*, and the land portion 37*h* of the coil conductor 32*h* are connected by the via conductor 33*g*.

The coil 30 having a substantially solenoid shape and incorporated in the multilayer body 10 is thus formed as described above.

As illustrated in FIG. 13, as viewed in plan in the stacking direction, the land portion of each of the coil conductor 32*e*, the coil conductor 32*f*, the coil conductor 32*g*, and the coil conductor 32*h* is not located inside the inner periphery of the line portion, and partially overlaps the line portion. The above-mentioned positional relationship between the line and land portions of each coil conductor ensures that the coil diameter (inside diameter) of the coil conductor does not decrease even at the position where the land portion is located, and thus a large impedance is obtained in the radio frequency range.

As viewed in plan in the stacking direction, for each of the coil conductor 32*e*, the coil conductor 32*f*, the coil conductor 32*g*, and the coil conductor 32*h*, its land portion has a diameter of not less than about 1.05 times and not more than about 1.3 times (i.e., from about 1.05 times to about 1.3 times) the line width of the line portion.

As viewed in plan in the stacking direction, for each of the coil conductor 32*e*, the coil conductor 32*f*, the coil conductor 32*g*, and the coil conductor 32*h*, its line portion has a line width of preferably not less than about 30 μm and not more than about 80 μm (i.e., from about 30 μm to about 80 μm), more preferably not less than about 30 μm and not more than about 60 μm (i.e., from about 30 μm and not more than about 60 μm).

As viewed in plan in the stacking direction, for each of the coil conductor 32*e*, the coil conductor 32*f*, the coil conductor 32*g*, and the coil conductor 32*h*, the outer periphery of its land portion is preferably in contact with the inner periphery of the line portion.

As viewed in plan in the stacking direction, the coil 30 including the coil conductor 32*e*, the coil conductor 32*f*, the coil conductor 32*g*, and the coil conductor 32*h* may have a substantially circular shape, or may have a substantially polygonal shape.

As viewed in plan in the stacking direction, each of the land portion 37*e*, the land portion 37*f*, the land portion 37*g*, and the land portion 37*h* may have a substantially circular shape as illustrated in FIG. 13, or may have a substantially polygonal shape.

The insulating layer $\mathbf{35}a_1$ provided with the via conductor 33*p*, the insulating layer $\mathbf{35}a_2$ provided with the via conductor 33*p*, the insulating layer $\mathbf{35}a_3$ provided with the via conductor 33*p*, and the insulating layer $\mathbf{35}a_4$ provided with the via conductor 33*p* are stacked so as to overlap the insulating layer 31*e* that is provided with the coil conductor 32*e* and the via conductor 33*e*. Thus, as illustrated in FIG. 11, the via conductors 33*p* connect with each other to form the first connecting conductor 41, and the first connecting conductor 41 is exposed on the first end surface 11. As a result, the first outer electrode 21 and the coil conductor 32*e* are connected with each other by the first connecting conductor 41.

The insulating layer $\mathbf{35}b_1$ provided with the via conductor 33*q*, the insulating layer $\mathbf{35}b_2$ provided with the via conductor 33*q*, the insulating layer $\mathbf{35}b_3$ provided with the via conductor 33*q*, and the insulating layer $\mathbf{35}b_4$ provided with the via conductor 33*q* are stacked so as to overlap the insulating layer 31*h* that is provided with the coil conductor 32*h* and the via conductor 33*h*. Thus, as illustrated in FIG. 11, the via conductors 33*q* connect with each other to form the second connecting conductor 42, and the second connecting conductor 42 is exposed on the second end surface 12. As a result, the second outer electrode 22 and the coil conductor 32*h* are connected with each other by the second connecting conductor 42.

For the multilayer coil component 1, passing electric current from the first outer electrode 21 to the second outer electrode 22 causes an electric field F as illustrated in FIG. 11 to form in a region of the multilayer body 10 near the first major surface 13, between a portion of the first outer electrode 21 that covers the first major surface 13 and a portion of the second outer electrode 22 that covers the first major surface 13. If the land portion of each coil conductor (its portion with a relatively large area) is positioned to cross the electric field F, this may lead to increased stray capacitance and consequently degraded radio frequency characteristics of the multilayer coil component 1.

The configuration illustrated in FIGS. 12 and 13 is now considered from this point of view. As viewed in plan in the width direction, the land portions of coil conductors connected with each other by via conductors are located in the upper half region of the multilayer body 10 located opposite to the first major surface 13. More specifically, as viewed in plan in the width direction, the land portion 37*e* and the land portion 37*f* that are connected with each other by the via conductor 33*e*, the land portion 37*f* and the land portion 37*g* that are connected with each other by the via conductor 33*f*, the land portion 37*g* and the land portion 37*f* that are connected with each other by the via conductor 33*g*, and the land portion 37*g* and the land portion 37*h* that are connected with each other by the via conductor 33*g* are located in the upper half region of the multilayer body 10 located opposite to the first major surface 13. This configuration ensures that the land portions are not positioned to cross the electric field F. This helps to sufficiently reduce stray capacitance, thus further improving the radio frequency characteristics of the multilayer coil component 1.

As illustrated in FIG. 13, a portion of the multilayer body 10 that will become the first major surface 13 is indicated as a side 38*f* of the insulating layer 31*f* and a side 38*g* of the insulating layer 31*g*. A side 39*f* and a side 39*g*, which are respectively located opposite to the side 38*f* and the side 38*g*, correspond to a portion of the multilayer body 10 that will become the second major surface 14. The upper half region of the multilayer body 10 located opposite to the first major surface 13 means a region of the multilayer body 10 closer to the sides 39*f* and 39*g* than a middle line M, which is located at the middle position (the middle position in the height direction) between the sides 38*f* and 38*g* that will become the first major surface 13 and the sides 39*f* and 39*g* that will become the second major surface 14.

Land portions not involved in the connection between coil conductors, such as the land portion 37*e* connected to the via conductors 33*p* constituting the first connecting conductor 41 and the land portion 37*h* connected to the via conductors 33*q* constituting the second connecting conductor 42 (i.e., land portions involved in connecting coil conductors to the first connecting conductor 41 and to the second connecting conductor 42) may not be located in the upper half region of the multilayer body 10 located opposite to the first major surface 13.

The following describes preferred dimensions for each of the coil conductor 32*a*, the coil conductor 32*b*, the coil conductor 32*c*, the coil conductor 32*d*, the coil conductor 32*e*, the coil conductor 32*f*, the coil conductor 32*g*, and the coil conductor 32*h*, and for each of the first connecting conductor 41 and the second connecting conductor 42.

As viewed in plan in the stacking direction, each coil conductor has an inside diameter (coil diameter) of preferably not less than about 15% and not more than about 40% (i.e., from about 15% to about 40%) of the width dimension $W_1$ of the multilayer body 10.

Each connecting conductor has a length dimension (dimension in the length direction) of preferably not less than about 2.5% and not more than about 7.5% (i.e., from about 2.5% to about 7.5%), more preferably not less than about 2.5% and not more than about 5.0% (i.e., from about 2.5% to about 5.0%) of the length dimension $L_1$ of the multilayer body 10. This configuration results in reduced inductance of each connecting conductor, leading to improved radio frequency characteristics of the multilayer coil component 1.

Each connecting conductor has a width dimension (dimension in the width direction) of preferably not less than about 8% and not more than about 20% (i.e., from about 8% to about 20%) of the width dimension $W_1$ of the multilayer body 10.

Specific examples of preferred dimensions of each coil conductor and each connecting conductor will be described below separately for each of the multilayer coil component 1 of 0603 size, the multilayer coil component 1 of 0402 size, and the multilayer coil component 1 of 1005 size.

(1) Multilayer Coil Component 1 of 0603 Size

As viewed in plan in the stacking direction, each coil conductor has an inside diameter (coil diameter) of preferably not less than about 50 μm and not more than about 100 μm (i.e., from about 50 μm to about 100 μm).

Each connecting conductor has a length dimension of preferably not less than about 15 μm and not more than about 45 μm (i.e., from about 15 μm to about 45 μm), more preferably not less than about 15 μm and not more than about 30 μm (i.e., from about 15 μm to about 30 μm).

Each connecting conductor has a width dimension of preferably not less than about 30 μm and not more than about 60 μm (i.e., from about 30 μm to about 60 μm).

(2) Multilayer Coil Component 1 of 0402 Size

As viewed in plan in the stacking direction, each coil conductor has an inside diameter (coil diameter) of preferably not less than about 30 μm and not more than about 70 μm (i.e., from about 30 μm to about 70 μm).

Each connecting conductor has a length dimension of preferably not less than about 10 μm and not more than about 30 μm (i.e., from about 10 μm to about 30 μm), more preferably not less than about 10 μm and not more than about 25 μm (i.e., from about 10 μm to about 25 μm).

Each connecting conductor has a width dimension of preferably not less than about 20 μm and not more than about 40 μm (i.e., from about 20 μm to about 40 μm).

(3) Multilayer Coil Component 1 of 1005 Size

As viewed in plan in the stacking direction, each coil conductor has an inside diameter (coil diameter) of preferably not less than about 80 μm and not more than about 170 μm (i.e., from about 80 μm to about 170 μm).

Each connecting conductor has a length dimension of preferably not less than about 25 μm and not more than about 75 μm (i.e., from about 25 μm to about 75 μm), more preferably not less than about 25 μm and not more than about 50 μm (i.e., from about 25 μm to about 50 μm).

Each connecting conductor has a width dimension of preferably not less than about 40 μm and not more than about 100 μm (i.e., from about 40 μm to about 100 μm).

Method for Manufacturing Multilayer Coil Component

An exemplary method for manufacturing a multilayer coil component according to the present disclosure will be described below.

First, ceramic green sheets that will eventually become individual insulating layers are fabricated. For example, an organic binder such as polyvinyl butyral-based resin, an organic solvent such as ethanol or toluene, and a dispersant are added to a ferrite material, followed by kneading to form a slurry. Then, by using a method such as doctor-blade, each ceramic green sheet with a thickness of about 12 μm is fabricated.

Examples of ferrite materials include those fabricated by a method described below. First, iron, nickel, zinc, and copper oxide raw materials are mixed together and calcined at about 800° C. for about one hour. The resulting calcined product is ground in a ball mill and dried, thus yielding a Ni—Zn—Cu-based ferrite material (oxide powder mixture) with a mean grain diameter of about 2 μm.

In fabricating each ceramic green sheet by use of a ferrite material, the ferrite material used preferably has the following composition from the viewpoint of obtaining a high inductance: $FE_2O_3$ at not less than about 40 mol % and not more than about 49.5 mol % (i.e., from about 40 mol % to about 49.5 mol %); ZnO at not less than about 5 mol % and not more than about 35 mol % (i.e., from about 5 mol % to about 35 mol %); CuO at not less than about 4 mol % and not more than about 12 mol % (i.e., from about 4 mol % to about 12 mol %); and the remainder including NiO and trace amounts of additives (including incidental impurities).

Exemplary materials of a ceramic green sheet may include, besides magnetic materials such as the ferrite material mentioned above, non-magnetic materials such as glass-ceramic materials, and mixtures of magnetic and non-magnetic materials.

Subsequently, a conductor pattern that will eventually become each of a coil conductor and a via conductor is formed on each ceramic green sheet. For example, first, laser beam machining is applied to the ceramic green sheet to form a via hole with a diameter of not less than about 20 μm and not more than about 30 μm (i.e., from about 20 μm to about 30 μm). The via hole is then filled with a conductive paste such as a silver paste to form a via-conductor pattern, which is a conductor pattern that will become a via conductor. Further, a coil-conductor pattern, which is a conductor pattern that will become a coil conductor, is printed at a thickness of about 11 μm on the major surface of the ceramic green sheet by screen printing or other methods with a conductive paste such as a silver paste. An example of such a coil-conductor pattern printed is a conductor pattern corresponding to each coil conductor as illustrated in FIGS. 8 and 9, or a conductor pattern corresponding to each coil conductor as illustrated in FIGS. 12 and 13. At this time, a land portion pattern, which will eventually become a land portion, is formed such that the land portion pattern is not located inside the inner periphery of a line portion pattern, which will eventually become a line portion, and that the land portion pattern partially overlaps the line portion pattern. Further, the respective sizes of the land portion pattern and the line portion pattern are adjusted such that upon completion of the final multilayer coil component, the land portion has a diameter of not less than about 1.05 times and not more than about 1.3 times (i.e., from about 1.05 times to about 1.3 times) the line width of the line portion.

The resulting ceramic green sheet is then dried, thus obtaining a coil sheet with the coil-conductor pattern and the via-conductor pattern formed on the ceramic green sheet. The coil-conductor pattern and the via-conductor pattern on the coil sheet are connected with each other.

Separately from such coil sheets, via sheets with a via-conductor pattern formed on the ceramic green sheet are fabricated. The via-conductor pattern on each via sheet is a conductor pattern that will eventually become each via conductor constituting a connecting conductor.

Subsequently, coil sheets are stacked in a predetermined order such that a coil with a coil axis parallel to the mounting surface will be formed inside the multilayer body after separation into discrete chips and firing. Further, via sheets are stacked on the top and bottom of the stack of coil sheets.

Subsequently, the stack of coil sheets and the stack of via sheets are subjected to pressure bonding under heat to obtain a pressure-bonded body, which is then cut into smaller portions with dimensions corresponding to a predetermined chip size to thereby obtain discrete chips. The discrete chips are subjected to, for example, barrel finishing to have rounded corners and rounded edges.

Subsequently, each discrete chip is subjected to de-binding and firing at a predetermined temperature for a predetermined period of time to thereby form a multilayer body (fired body) with a coil incorporated therein. After the firing process, the coil-conductor pattern and the via-conductor pattern respectively become a coil conductor and a via conductor. The coil is made up of coil conductors connected by via conductors. The stacking direction of the multilayer body, and the direction of the coil axis of the coil are parallel to the mounting surface.

Subsequently, the multilayer body is immersed obliquely in a layer of a conductive paste such as a silver paste drawn into a predetermined thickness, following by baking to form an underlying electrode layer for the outer electrode on four faces (the major surface, the end surface, and both lateral surfaces) of the multilayer body. As opposed to a method of forming an underlying electrode layer on each of the major surface and the end surface of the multilayer body in two separate steps, the above-mentioned method makes it possible to form the underlying electrode layer at once in a single step.

Subsequently, a nickel coating and a tin coating are sequentially formed at a predetermined thickness on the underlying electrode layer by plating. As a result, an outer electrode is formed.

Through the above-mentioned process, the multilayer coil component according to the present disclosure is manufactured.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer coil component comprising:

a multilayer body formed by stacking a plurality of insulating layers in a length direction, the multilayer body including a coil built in the multilayer body; and a first outer electrode and a second outer electrode that are electrically connected to the coil, wherein the coil is formed by electrically connecting a plurality of coil conductors, the coil conductors being stacked in the length direction together with the insulating layers, wherein the multilayer body has a first end surface and a second end surface that face each other in the length direction, a first major surface and a second major surface that face each other in a height direction orthogonal to the length direction, and a first lateral surface and a second lateral surface that face each other in a width direction orthogonal to the length direction and to the height direction, wherein the first major surface is a mounting surface, wherein a stacking direction of the multilayer body, and a direction of a coil axis of the coil are parallel to the first major surface, wherein the first outer electrode extends to cover at least a portion of the first end surface and to cover a portion of the first major surface, wherein the second outer electrode extends to cover at least a portion of the second end surface and to cover a portion of the first major surface, wherein each coil conductor has a line portion, and a land portion disposed in an end portion of the line portion, wherein the land portions of the coil conductors that are adjacent to each other in the stacking direction are connected with each other by a via conductor, wherein as viewed in plan in the stacking direction, the land portion is not located inside an inner periphery of the line portion, and partially overlaps the line portion, and wherein as viewed in plan in the stacking direction, the land portion has a diameter of from 1.05 times to 1.3 times a line width of the line portion, and the diameter of the land portion is greater than a diameter of the via conductor.

2. The multilayer coil component according to claim 1, wherein as viewed in plan in the stacking direction, the line width of the line portion is from 30 μm to 80 μm.

3. The multilayer coil component according to claim 2, wherein as viewed in plan in the stacking direction, the line width of the line portion is from 30 μm to 60 μm.

4. The multilayer coil component according to claim 3, wherein a number of the stacked coil conductors is from 40 to 60.

5. The multilayer coil component according to claim 3, wherein a distance between the coil conductors that are adjacent to each other in the stacking direction is from 3 μm to 10 μm.

6. The multilayer coil component according to claim 3, wherein a number of the stacked coil conductors that define one turn of the coil is two.

7. The multilayer coil component according to claim 3, wherein the first outer electrode extends to cover a portion of the first end surface and a portion of the first major surface, the second outer electrode extends to cover a portion of the second end surface and a portion of the first major surface, and as viewed in plan in the width direction, the land portion is located in an upper half region of the multilayer body located opposite to the first major surface.

8. The multilayer coil component according to claim 2, wherein a number of the stacked coil conductors is from 40 to 60.

9. The multilayer coil component according to claim 2, wherein a distance between the coil conductors that are adjacent to each other in the stacking direction is from 3 μm to 10 μm.

10. The multilayer coil component according to claim 2, wherein a number of the stacked coil conductors that define one turn of the coil is two.

11. The multilayer coil component according to claim 2, wherein the first outer electrode extends to cover a portion of the first end surface and a portion of the first major surface, the second outer electrode extends to cover a portion of the second end surface and a portion of the first major surface, and as viewed in plan in the width direction, the land portion is located in an upper half region of the multilayer body located opposite to the first major surface.

12. The multilayer coil component according to claim 1, wherein a number of the stacked coil conductors is from 40 to 60.

13. The multilayer coil component according to claim 12, wherein a distance between the coil conductors that are adjacent to each other in the stacking direction is from 3 μm to 10 μm.

14. The multilayer coil component according to claim 12, wherein a number of the stacked coil conductors that define one turn of the coil is two.

15. The multilayer coil component according to claim 12, wherein the first outer electrode extends to cover a portion of the first end surface and a portion of the first major surface, the second outer electrode extends to cover a portion of the second end surface and a portion of the first major surface, and as viewed in plan in the width direction, the land portion is located in an upper half region of the multilayer body located opposite to the first major surface.

16. The multilayer coil component according to claim 1, wherein a distance between the coil conductors that are adjacent to each other in the stacking direction is from 3 μm to 10 μm.

17. The multilayer coil component according to claim 16, wherein a number of the stacked coil conductors that define one turn of the coil is two.

18. The multilayer coil component according to claim 16, wherein the first outer electrode extends to cover a portion of the first end surface and a portion of the first major surface, the second outer electrode extends to cover a portion of the second end surface and a portion of the first major surface, and as viewed in plan in the width direction, the land portion is located in an upper half region of the multilayer body located opposite to the first major surface.

19. The multilayer coil component according to claim 1, wherein a number of the stacked coil conductors that define one turn of the coil is two.

20. The multilayer coil component according to claim 1, wherein the first outer electrode extends to cover a portion of the first end surface and a portion of the first major surface, the second outer electrode extends to cover a portion of the second end surface and a portion of the first major surface, and as viewed in plan in the width direction, the land portion is located in an upper half region of the multilayer body located opposite to the first major surface.

* * * * *